US010668763B2

(12) United States Patent
Liao et al.

(10) Patent No.: US 10,668,763 B2
(45) Date of Patent: Jun. 2, 2020

(54) PET SYNTHETIC PAPER

(71) Applicant: NAN YA PLASTICS CORPORATION, Taipei (TW)

(72) Inventors: Te-Chao Liao, Taipei (TW); Wen-Cheng Yang, Taipei (TW); Ching-Yao Yuan, Taipei (TW); Chen-An Wu, Taipei (TW); Yu-Chi Hsieh, Taipei (TW)

(73) Assignee: NAN YA PLASTICS CORPORATION, Taipei (TW)

( * ) Notice: Subject to any disclaimer, the term of this patent is extended or adjusted under 35 U.S.C. 154(b) by 0 days.

(21) Appl. No.: 16/523,586

(22) Filed: Jul. 26, 2019

(65) Prior Publication Data

US 2020/0122496 A1 Apr. 23, 2020

(30) Foreign Application Priority Data

Oct. 19, 2018 (TW) ..... 107136855 A

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/5227* (2013.01); *B41M 5/508* (2013.01); *B41M 5/52* (2013.01); *B41M 5/5218* (2013.01); *B41M 5/5281* (2013.01)

(58) Field of Classification Search

CPC ..... B41M 5/52; B41M 5/5218; B41M 5/5281
USPC ..... 428/32.36
See application file for complete search history.

(56) References Cited

U.S. PATENT DOCUMENTS

2010/0047525 A1* 2/2010 Chen ..... B29C 45/1418 428/147

* cited by examiner

*Primary Examiner* — Betelhem Shewareged
(74) *Attorney, Agent, or Firm* — Li & Cai Intellectual Property (USA) Office

(57) ABSTRACT

A PET synthetic paper is composed of a PET substrate and a soft ink absorbing coating coated on the PET substrate. The soft ink absorbing coating includes an acrylic coating and a polyurethane coating embossed on the acrylic coating. The acrylic coating has excellent printability and the polyurethane coating has velvety-soft tactility.

8 Claims, 1 Drawing Sheet

PET SYNTHETIC PAPER

CROSS-REFERENCE TO RELATED PATENT APPLICATION

This application claims the benefit of priority to Taiwan Patent Application No. 107136855, filed on Oct. 19, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a PET synthetic paper, and more particularly to a PET synthetic paper for traditional lithography, digital printing and inkjet printing.

BACKGROUND OF THE DISCLOSURE

Conventional natural wood pulp paper and polyolefin synthetic paper can be used in traditional lithography, digital printing and inkjet printing. However, the tactilities of those kinds of papers are rough and lack softness.

In order to increase the popularity and usage of polyolefin synthetic paper, it has become an important issue in the field of synthetic paper to develop a synthetic paper with good softness, good elasticity, good printing performance, good ink adhesion and good water resistance.

SUMMARY OF THE DISCLOSURE

In response to the above-referenced technical inadequacies, the present disclosure provides a PET synthetic paper with velvety-soft tactility, low gloss and excellent printability.

In one aspect, the present disclosure provides a PET synthetic paper consisting of a PET substrate and a soft ink absorbing coating coated on the PET substrate and having a thickness of 4 to 24 μm. The soft ink absorbing coating includes an acrylic coating and a polyurethane coating embossed on the acrylic coating and being island-shaped, and based on the total weight of the soft ink absorbing coating, the composition of the soft ink absorbing coating includes the following components and the total of each of the components is 100 wt %:

(1) 2-40 wt % of polyurethane resins, wherein the polyurethane resin is an elastomer and the main chain of the elastomer is a polymer formed of polyisocyanates and polyols;

(2) 2-40 wt % of acrylic resin monomers;

(3) 0.5-30 wt % of crosslinking agents, which is selected from one or any combination of an isocyanate crosslinking agent, an aziridine crosslinking agent, an oxazoline crosslinking agent and a carbodiimide crosslinking agent;

(4) 0.05-30 wt % of surface modified filled particles;

(5) 0.5-30 wt % of blowing agents selected from an N-nitroso compound, an azo compound and a hydrazide compound;

(6) 0.05-10 wt % of additives selected from one or any combination of an auxiliary, a catalyst and a cosolvent; and (7) 50-85 wt % of aqueous solvents.

Therefore, the PET synthetic paper of the present disclosure provides velvety-soft tactility, low gloss and excellent printability so that the acceptance and use rate of synthetic paper can be enhanced.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
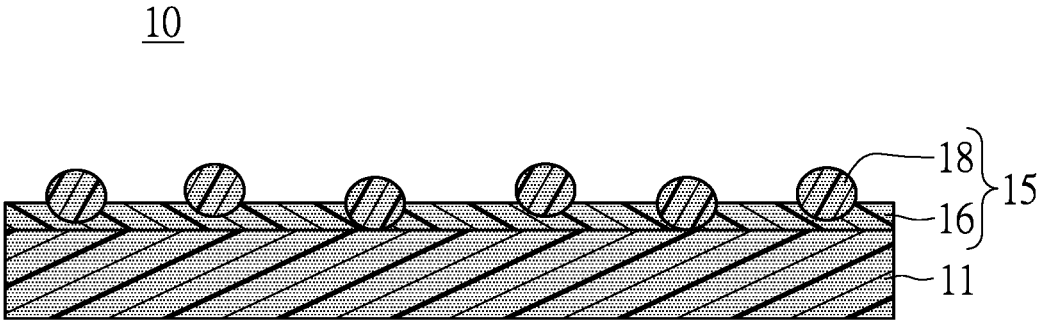
FIG. 1 is a schematic view showing the structure of a PET synthetic paper according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

As shown in FIG. 1, a PET synthetic paper 10 of the present disclosure is a PET synthetic paper for traditional lithography, digital printing and inkjet printing with velvety-soft tactility, low gloss and excellent printability. The PET synthetic paper 10 consists of a PET substrate 11 and a soft ink absorbing coating 15. The soft ink absorbing coating 15 is a coating including sea-island polyurethane and an acrylic resin. The acrylic resin forms a sea-shaped acrylic coating 16, and the polyurethane is embossed on the acrylic coating 16 to form island-shaped polyurethane coatings 18. The soft ink absorbing coating 15 is coated on the surface of the PET substrate 11 to form a coating on the surface of the PET substrate 11.

With the polyurethane coating 18 of the soft ink absorbing coating 15, the PET synthetic paper 10 of the present disclosure has characteristics of velvety-soft tactility and low gloss, and with the acrylic coating 16 of the soft ink absorbing coating 15, the PET synthetic paper 10 of the present disclosure can be used in traditional lithography, digital printing and inkjet printing.

The soft ink absorbing coating 15 is a water-soluble coating fluid including the following components based on the total weight of the coating fluid, and the total of each of the components is 100 wt %:

(1) 2-40 wt % of polyurethane resins;
(2) 2-40 wt % of acrylic resin monomers;
(3) 0.5-30 wt % of crosslinking agents;
(4) 0.05-30 wt % of surface modified filled particles;
(5) 0.5-30 wt % of blowing agents;
(6) 0.05-10 wt % of additives; and
(7) 50-85 wt % of aqueous solvents.

The polyurethane resin of the present disclosure is an elastomer and a main chain thereof is a linear polymer formed of polyisocyanates and polyols, and then extended with ethylenediamine to obtain a "soft segment" nonionic group with polyether or polyester. The side chain thereof has an anionic group containing a sulfonic acid group and a nonionic group.

The polyisocyanate is selected from toluene diisocyanate (TDI), isophorone diisocyanate (IPDI), methylenediphenyl diisocyanate (MDI), dicyclohexylmethane diisocyanate (HMDI), lysine diisocyanate (LDI), p-phenylene diisocyanate (PPDI), naphthalene diisocyanate (NDI), dimethyl biphenyl diisocyanate (TODI), cyclohexane diisocyanate (CHDI), tetramethylxylylene diisocyanate (TMXDI), and 1,3-bis(isocyanatomethyl)cyclohexane (H6XDI).

The polyol may be a polyester polyol and a polyether polyol. The polyester polyol is obtained by condensation of a low molecular weight diols and a dicarboxylic acid, for example: a condensed polyester polyol obtained by condensation of a low molecular polyol such as ethylene glycol, 1,3-propanediol, 1,4-butanediol, 1,6-hexanediol with an aliphatic dicarboxylic acid such as succinic acid, glutaric acid, adipic acid, pimelic acid, suberic acid, azelic acid, sebacic acid, decanedicarboxylic acid, and cyclohexanedicarboxylic acid, and also, a cyclic ester such as ε-caprolactone and a polyester polyol such as hexamethylenediamine or isophorone diamine by the reaction of a part of diol. The polyols mentioned above may be used in single or in plurality, and copolymers thereof can also be used.

The polyether polyol is selected from one or any combination of polytetramethylene ether glycol (PTMEG), polypropylene glycol (PPG), and a polyether compound with a main chain and a side chain of polyethylene glycol (PEG).

The acrylic resin monomer is selected from one or any combination of methyl (meth)acrylate (MMA), ethyl acrylate (EA), propyl (meth)acrylate (PA), butyl acrylate (BA), isobutyl (meth)acrylate (IBA), amyl (meth)acrylate, hexyl (meth)acrylate, heptyl (meth)acrylate, octyl (meth)acrylate, 2-ethylhexyl (meth)acrylate (2-HEA), n-octyl (meth)acrylate (OA), isooctyl (meth)acrylate (IOA), nonyl (meth) acrylate (NA), decyl (meth)acrylate, lauryl acrylate (LA), octadecyl (meth)acrylate, methoxyethyl (meth)acrylate (MOEA), n-butyl methacrylate (n-BMA), 2-ethylhexyl acrylate (2-EHA) and ethoxymethyl (meth)acrylate (EO-MAA) as a coating resin shaped like the water surrounding islands.

The crosslinking agent is at least one selected from the group consisting of melamine, a hydroxymethyl modified melamine derivative in which melamine is condensed with formaldehyde, an isocyanate crosslinking agent, an aziridine crosslinking agent, an oxazoline crosslinking agent and a carbodiimide crosslinking agent. In the present disclosure, the crosslinking agent is preferably used in an amount of 0.5 to 30 wt %, more preferably 1 to 20 wt %.

The filled particle is selected from one or any combination of silicon oxide, titanium oxide, aluminum oxide, aluminum hydroxide, calcium carbonate, calcium phosphate and barium sulfate, and has a particle diameter of 0.005 to 10 μm. The filled particles having different particle diameters can also be chosen according to different physical requirements such as transparency, haze, slipperiness, and anti-adhesiveness. When the filled particle has a larger particle diameter, the anti-adhesiveness at a high temperature has a better effect. When the dispersibility of the filled particle is better, the filled particle is less likely to be agglomerated and the PET synthetic paper of the present disclosure has lower haze.

The filled particle of the present disclosure is surface-modified by using a surface modification treatment agent. The surface modification treatment agent is selected from one or any combination of a vinylsilane coupling agent, an epoxy silane coupling agent, a styrene silane coupling agent, a methacryloyloxy silane coupling agent, an acryloxy silane coupling agent, an aminosilane coupling agent, an isocyanurate silane coupling agent, a urea silane coupling agent and an isocyanate silane coupling agent. Inorganic particles modified by the surface modification treatment agent have better dispersibility, compatibility, and adhesion. In the present disclosure, the surface modification treatment agent is preferably used in an amount of 0.5 to 30 wt %, more preferably 5 to 20 wt %.

The additive is selected from one or any combination of an auxiliary, a catalyst and a cosolvent. The auxiliary is used to adjust the surface tension of the water-soluble coating fluid, and improve the wettability of the coating and substrate formed of the water-soluble coating fluid and the evenness or smoothness of the coating. The catalyst is used to control the reaction rate of a coating bridge. The cosolvent is used to control the evaporation rate of fluid components.

The auxiliary includes an auxiliary containing silicon, fluorine or silicon/fluorine-containing. The silicon-containing auxiliary may be selected from one or more of BYK307, BYK325, BYK331, BYK380N and BYK381 of BYK. The fluorine-containing auxiliary may be selected from one or more of FC-4430 and FC-4432 of 3M, Zonyl FSN-100 of DuPont USA, and DSX of Daikin Industries, Ltd. The silicon/fluorine-containing auxiliary may be selected from one or more of BYK346, BYK347 and BYK348.

The catalyst is an inorganic substance, a salt, an organic substance, an alkaline substance, an acidic substance, or the like. The cosolvent is methanol, ethanol, n-propanol, isopropanol, butanol, isobutanol, dimethyl sulfoxide, acetone or tetrahydrofuran.

As shown in FIG. 1, the PET synthetic paper 10 of the present disclosure is produced by a traditional off-line gravure coating, in which the soft ink absorbing coating 15 is coated on the surface of the PET substrate 11, has a thickness of 4 to 24 μm, preferably 5 to 20 μm and can be coated on both surfaces of the PET substrate 11.

After the coating, the soft ink absorbing coating 15 is dried at 120° C., and the polyurethane resin of the soft ink absorbing coating 15 is foamed by the blowing agent to generate micropores and form the convex polyurethane coating 18. Accordingly, the surface of the PET synthetic paper 10 of the present disclosure provides velvety-soft tactility and has a well coated appearance.

At 120° C., the acrylic resin of the soft ink absorbing coating 15 generates micropores by the blowing agent and forms the even acrylic coating 16 so as to increase ink absorption performance during printing. Accordingly, the PET synthetic paper 10 of the present disclosure can be used in traditional lithography, digital printing and inkjet printing.

The addition of the surface modified filled particle to the soft ink absorbing coating 15 increases the ink absorbing ability and the surface friction of the PET synthetic paper 10 of the present disclosure, and prevents the PET synthetic paper 10 from paper jam or scratches on the surface thereof.

Moreover, the additive can improve the coating of the soft ink absorbing coating 15 so that the soft ink absorbing coating has a uniform coating and an intact appearance.

The following embodiments are given to illustrate the contents of the present disclosure and the effects which can be achieved, but the present disclosure is not limited to the embodiments. The physical properties of the embodiments are evaluated in terms of the following aspects:

(1) coating appearance: the coating appearance is placed under visual observation in a strong light environment.

(2) tactility: one touches and feels the texture with a finger.

(3) water resistance: the PET synthetic paper including the soft absorbing coating and the PET synthetic paper after printing are immersed in water for 24 hours to observe whether the ink is smudged. The printing surface of the PET synthetic paper is tested by wiping 10 times with a wet hand towel to observe whether the color of the ink falls off or not. If the ink does not fall off, the PET synthetic paper is evaluated as good.

(4) printing performance: printing machines used include a traditional lithographic print press, a digital inkjet printer HP5800, a digital inkjet printer in HP Indigo series, a dry laser printer in HP CP1000 series.

(5) color ink adhesion: 3M Scotch tape is stuck onto the printed PET synthetic paper, and is pressed 5 times by a finger to reinforce the adhesion between the tape and the surface of the printed PET synthetic paper. Then, the tape is peeled off quickly to observe whether the color of the ink falls off. If the ink does not fall off, the PET synthetic paper is evaluated as good, and if the ink falls off, it is evaluated as poor.

Embodiment 1

According to the formula in Table 1, the water-soluble coating fluid used to form a soft ink absorbing coating includes 20 g of a polyurethane resin, 8 g of an acrylic resin, 1.0 g of a melamine crosslinking agent, 0.5 g of an oxazoline crosslinking agent, 0.1 g of an anionic surfactant A, 0.25 g of a nonionic surfactant B, 0.1 g of a silicon-containing compound as the surface modification treatment agent, 1.2 g of the blowing agent, 1.6 g of silicon oxide particles A having a particle diameter of 2 μm, 3.6 g of silicon oxide particles B having a particle diameter of 0.1 μm, 62.32 g of water, 0.1 g of a catalyst, and 1.2 g of butyl cellulose and 0.03 g of silicon or fluorine-containing auxiliary. After being stirred uniformly, the water-soluble coating fluid is uniformly coated on a PET substrate up to 10 μm, and the coated PET substrate is introduced into a heating zone of 120° C. to remove the moisture of the water-soluble coating fluid (or the coating layer) and foam the polyurethane resin in the coating layer to be micropores so as to become a convex polyurethane coating. Accordingly, the PET synthetic paper is manufactured and the physical properties thereof are measured as shown in Table 1.

Embodiment 2

According to the formula in Table 1, the water-soluble coating fluid used to form the soft ink absorbing coating is prepared. Compared with the formula of Embodiment 1, in Embodiment 2, the amount of silicon-containing compound is reduced from 0.1 g to 0.05 g, the amount of silicon oxide particles A is increased from 1.6 to 2.1 g, and the amount of silicon oxide particles B is reduced from 3.6 to 2.5 g. The physical properties of the manufactured PET synthetic paper are shown in FIG. 1.

Embodiment 3

According to the formula in Table 1, the water-soluble coating fluid used to form the soft ink absorbing coating is prepared. Compared with the formula of Embodiment 1, in Embodiment 3, the amounts of resin, surface modification treatment agent, filled particles, and additive are doubled. The water-soluble coating fluid includes 40 g of the polyurethane resin, 16 g of the acrylic resin, 1.5 g of the melamine crosslinking agent, 1.2 g of the oxazoline crosslinking agent, 0.2 g of the anionic surfactant A, 0.5 g of the nonionic surfactant B, 25.24 g of water, 0.2 g of the catalyst, and 2.4 g of butyl cellulose and 0.06 g of the silicon or fluorine-containing auxiliary. After being stirred uniformly, the water-soluble coating fluid is uniformly coated on the PET substrate up to 10 μm, and the coated PET substrate is introduced into the heating zone of 120° C. to remove the moisture of the water-soluble coating fluid (or the coating layer) and foam the polyurethane resin in the coating layer to be micropores so as to become the convex polyurethane coating. Accordingly, the PET synthetic paper is manufactured and the physical properties thereof are measured as shown in Table 1.

Embodiment 4

According to the formula in Table 1, the water-soluble coating fluid used to form the soft ink absorbing coating is prepared. Compared with the formula of Embodiment 1, in Embodiment 4, the amounts of resin, surface modification treatment agent, filled particles, and additive are reduced to a half. The water-soluble coating fluid includes 10 g of the polyurethane resin, 4 g of the acrylic resin, 0.5 g of the melamine crosslinking agent, 0.25 g of the oxazoline crosslinking agent, 0.05 g of the anionic surfactant A, 0.1 g of the nonionic surfactant B, 0.1 g of the silicon-containing compound as the surface modification treatment agent, 0.6 g of the blowing agent, 0.8 g of silicon oxide particles A having a particle diameter of 2 μm, 2.0 g of silicon oxide particles B having a particle diameter of 0.1 μm, 80.89 g of water, 0.1 g of the catalyst, 0.6 g of butyl cellulose and 0.01 g of the silicon or fluorine-containing auxiliary. After being stirred uniformly, the water-soluble coating fluid is uniformly coated on the PET substrate up to 10 μm, and the coated PET substrate is introduced into the heating zone of 120° C. to remove the moisture of the water-soluble coating fluid (or the coating layer) and foam the polyurethane resin in the coating layer to be micropores so as to become the convex polyurethane coating. Accordingly, the PET synthetic paper is manufactured and the physical properties thereof are measured as shown in Table 1.

Comparative Example 1

According to the formula in Table 1, the water-soluble coating fluid used to form the soft ink absorbing coating is prepared. Compared with the formula of Embodiment 1, in Comparative example 1, the crosslinking agent is not used, and the amount of water is 62.17. The physical properties of the manufactured PET synthetic paper are shown in FIG. 1.

Comparative Example 2

According to the formula in Table 1, the water-soluble coating fluid used to form the soft ink absorbing coating is prepared. Compared with the formula of Embodiment 1, in Embodiment 4, the blowing agent is not used and the amount of crosslinking agent is increased. The water-soluble coating fluid includes 20 g of the polyurethane resin, 8 g of the acrylic resin, 5.0 g of the melamine crosslinking agent, 3.0 g of the oxazoline crosslinking agent, 0.1 g of the anionic surfactant A, 0.25 g of the nonionic surfactant B, 0.1 g of the silicon-containing compound as the surface modification treatment agent, 1.6 g of silicon oxide particles A having a particle diameter of 2 μm, 3.6 g of silicon oxide particles B having a particle diameter of 0.1 μm, 62.32 g of water, 0.1 g of the catalyst, 1.2 g of butyl cellulose and 0.03 g of the silicon or fluorine-containing auxiliary. After being stirred uniformly, the water-soluble coating fluid is uniformly coated on the PET substrate up to 10 μm, and the coated PET substrate is introduced into the heating zone of 120° C. to remove the moisture of the water-soluble coating fluid (or the coating layer) and foam the polyurethane resin in the coating layer to be micropores so as to become the convex polyurethane coating. Accordingly, the PET synthetic paper is manufactured and the physical properties thereof are measured as shown in Table 1.

Comparative Example 3

According to the formula in Table 1, the water-soluble coating fluid used to form the soft ink absorbing coating is prepared. Compared with the formula of Embodiment 1, in Comparative example 3, the surface modification treatment agent is not used. The physical properties of the manufactured PET synthetic paper are shown in FIG. 1.

Comparative Example 4

According to the formula in Table 1, the water-soluble coating fluid used to form the soft ink absorbing coating is prepared. Compared with the formula of Embodiment 1, in Comparative example 4, the filled particle is not used. The physical properties of the manufactured PET synthetic paper are shown in FIG. 1.

TABLE 1

Formulae of water-soluble coating fluid and physical properties of PET synthetic paper

| Item | | Embod. 1 | Embod. 2 | Embod. 3 | Embod. 4 | Comp. Ex. 1 | Comp. Ex. 2 | Comp. Ex. 3 | Comp. Ex. 4 |
|---|---|---|---|---|---|---|---|---|---|
| Resin | Polyurethane resin | 20 | 20 | 40 | 10 | 20 | 20 | 20 | 20 |
| | Acrylic resin | 8 | 8 | 16 | 4 | 8 | 8 | 8 | 8 |
| Crosslinking agent | Melamine | 1.00 | 1.00 | 1.5 | 0.5 | 0 | 5 | 1.00 | 1.00 |
| | Oxazoline | 0.5 | 0.5 | 1.2 | 0.25 | 0 | 3 | 0.5 | 0.5 |
| Solvent | Water | 62.32 | 62.32 | 25.24 | 80.89 | 62.17 | 63.37 | 62.32 | 62.32 |
| Surface modification treatment agent | Surfactant A | 0.1 | 0.1 | 0.2 | 0.05 | 0.1 | 0.1 | 0 | 0.1 |
| | Surfactant B | 0.25 | 0.25 | 0.5 | 0.1 | 0.25 | 0.25 | 0 | 0.25 |
| | Silicon-containing compound | 0.1 | 0.05 | 0.2 | 0.1 | 0.1 | 0.1 | 0 | 0.1 |
| Blowing agent | | 1.2 | 1.2 | 2.5 | 0.6 | 1.2 | 0 | 1.2 | 1.2 |
| Filled particle | Particle A (particle diameter 2 μm) | 1.6 | 2.1 | 3.2 | 0.8 | 1.6 | 1.6 | 1.6 | 0 |
| | Particle B (particle diameter 0.1 μm) | 3.6 | 2.5 | 7.2 | 2 | 3.6 | 3.6 | 3.6 | 0 |
| Additive | Catalyst | 0.10 | 0.10 | 0.2 | 0.10 | 0.10 | 0.10 | 0.10 | 0.10 |
| | Butyl cellulose | 1.2 | 1.2 | 2.4 | 0.6 | 1.2 | 1.2 | 1.2 | 1.2 |
| | Cerium or fluorine-containing auxiliary | 0.03 | 0.03 | 0.06 | 0.01 | 0.03 | 0.03 | 0.03 | 0.03 |
| Physical property comparative item | Coating appearance | Good | Good | Good | Good | Good | Good | Textured | Good |
| | Tactility | Soft | Soft | Soft | Soft | Soft | Hard | Soft | Soft |
| | Water resistance | Good | Good | Good | Good | Good | Good | Good | Good |
| | Printing performance | Good | Good | Good | Good | Good | Good | Good | Poor |
| | Color ink adhesion | Good | Good | Good | Good | Poor | Good | Good | Good |

TABLE 1-continued

| Formulae of water-soluble coating fluid and physical properties of PET synthetic paper | | | | | | | | |
|---|---|---|---|---|---|---|---|---|
| Item | Embod. 1 | Embod. 2 | Embod. 3 | Embod. 4 | Comp. Ex. 1 | Comp. Ex. 2 | Comp. Ex. 3 | Comp. Ex. 4 |
| Continuous printing without paper jam | Good | Good | Good | Good | Good | Good | Good | Poor |

(It should be noted that "Embod." represents "Embodiment" and "Comp. Ex." represents "Comparative Example".)

In conclusion:

1. Accordingly, the water-soluble coating of the present disclosure includes the polyurethane resin, the acrylic resin, the crosslinking agent, the surface modified filled particles and other additives, and is coated on the PET substrate to form the soft ink absorbing coating, so that the transparency, hand touch, the coating appearance of the PET synthetic paper are greatly improved. Therefore the PET synthetic paper can be applied in traditional lithography, digital printing and inkjet printing for having good printing performance, color ink adhesion and water resistance.
2. Since in the water-soluble coating fluid in Embodiments 1 to 4, the polyurethane resin and the acrylic resin react with the crosslinking agent to form the soft ink absorbing coating of the PET synthetic paper, the coating surface of the manufactured PET synthetic paper gives soft tactility and has low gloss and good color ink adhesion. Furthermore, the surface modified filled particles are added into the soft ink absorbing coating in good dispersibility, such that the ink adhesion and print performance of the PET synthetic paper are improved and the colors printed are more vivid. In addition, the soft ink absorbing coating is mixed with the filled particles having different particle diameters, such that the slipperiness and the effect of continuous printing without paper jam of the PET synthetic paper are improved.
3. Compared with the water-soluble coating fluid in Embodiment 1, in Embodiment 2, filled particles with different particle diameters and in different amounts are used, so that the particle diameter and the amount of the filled particle can be adjusted according to different requirement for printing so as to obtain better printing performance. For example, as traditional lithography transfer printing requires a small amount of ink absorption, the ratio of filled particles having a larger particle diameter is increased to obtain better performance of printing and transferring.
4. Compared to the water-soluble coating fluid of Embodiment 1, in the water-soluble coating fluids in Embodiments 3 and 4, the amounts of resins, crosslinking agents, surface modification treatment agent s, filled particles, blowing agents and additive are doubled or reduced to a half, and the physical properties of the manufactured PET synthetic papers are normal. Based on the above, it can be concluded that the water-soluble coating fluid of the present disclosure has a wide range of composition.
5. In the water-soluble coating fluid of Comparative example 2, the blowing agent is not used and the amount of crosslinking agent is increased, such that the coating surface of the PET synthetic paper has hard tactility instead of soft tactility, but the color ink adhesion of the PET synthetic paper is maintained.
6. In the water-soluble coating fluid of Comparative example 3, the surface modification treatment agent is not used, such that the coating surface of the PET synthetic paper is not even or smooth, with coating textures like lunula and bubble spots.
7. In the water-soluble coating fluid of Comparative example 4, the filled particle is not used, such that the PET synthetic paper has poor ink absorption, printing quality, printing and continuous printing performances.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A polyethylene terephthalate (PET) synthetic paper consists of a PET substrate and a soft ink absorbing coating coated on the PET substrate and having a thickness of 4 to 24 μm, wherein, the soft ink absorbing coating includes an acrylic coating and an island-shaped polyurethane coating embossed on the acrylic coating, and based on the total weight of the soft ink absorbing coating, the composition of the soft ink absorbing coating includes the following components and the total of each of the components is 100 wt %:

(1) 2-40 wt % of polyurethane resins;
(2) 2-40 wt % of acrylic resin monomers;
(3) 0.5-30 wt % of crosslinking agents;
(4) 0.05-30 wt % of surface modified filled particles;
(5) 0.5-30 wt % of blowing agents;
(6) 0.05-10 wt % of additives; and
(7) 50-85 wt % of aqueous solvents.

2. The PET synthetic paper according to claim 1, wherein the polyurethane resin is a water-soluble or water-dispersible polyurethane resin, the polyurethane resin is an elastomer and the main chain of the elastomer is a polymer formed of polyisocyanates and polyols.

3. The PET synthetic paper according to claim 1, wherein the acrylic resin monomer is selected from one or any combination of methyl (meth)acrylate (MMA), ethyl acrylate (EA), propyl (meth)acrylate (PA), butyl acrylate (BA), isobutyl (meth)acrylate (IBA), amyl (meth)acrylate, hexyl (meth)acrylate, heptyl (meth)acrylate, octyl (meth)acrylate, 2-ethylhexyl (meth)acrylate (2-HEA), n-octyl (meth)acrylate (OA), isooctyl (meth)acrylate (IOA), nonyl (meth) acrylate (NA), decyl (meth)acrylate, lauryl acrylate (LA), octadecyl (meth)acrylate, methoxyethyl (meth)acrylate (MOEA), n-butyl methacrylate (n-BMA), 2-ethylhexyl acrylate (2-EHA) and ethoxymethyl (meth)acrylate (EO-MAA).

4. The PET synthetic paper according to claim 1, wherein the crosslinking agent is selected from melamine and a hydroxymethyl modified melamine derivative in which melamine is condensed with formaldehyde.

5. The PET synthetic paper according to claim 1, wherein the crosslinking agent is selected from one or any combination of isocyanate crosslinking agent, an aziridine crosslinking agent, an oxazoline crosslinking agent and a carbodiimide crosslinking agent.

6. The PET synthetic paper according to claim 1, wherein the filled particle is selected from one or any combination of silicon oxide, titanium oxide, aluminum oxide, aluminum hydroxide, calcium carbonate, calcium phosphate and barium sulfate, and has a particle diameter of 0.005 to 10 μm.

7. The PET synthetic paper according to claim 1, wherein the blowing agent is selected from an N-nitroso compound, an azo compound and a hydrazide compound.

8. The PET synthetic paper according to claim 1, wherein the additive is selected from one or any combination of an auxiliary, a catalyst and a cosolvent.

* * * * *